US010619653B2

(12) United States Patent
Grupp et al.

(10) Patent No.: US 10,619,653 B2
(45) Date of Patent: Apr. 14, 2020

(54) ELECTROHYDRAULIC LINEAR ACTUATOR

(71) Applicant: HOERBIGER AUTOMATISIERUNGSTECHNIK HOLDING GMBH, Altenstadt (DE)

(72) Inventors: Matthias Grupp, Lapeer, MI (US); Peter Roider, Lappersdorf (DE)

(73) Assignee: HAWE ALTENSTADT HOLDING GMBH, Altenstadt (DE)

( * ) Notice: Subject to any disclaimer, the term of this patent is extended or adjusted under 35 U.S.C. 154(b) by 0 days.

(21) Appl. No.: 16/195,283

(22) Filed: Nov. 19, 2018

(65) Prior Publication Data

US 2019/0085873 A1 Mar. 21, 2019

Related U.S. Application Data

(63) Continuation of application No. PCT/EP2017/061625, filed on May 15, 2017.

(30) Foreign Application Priority Data

May 18, 2016 (DE) ..... 10 2016 109 103

(51) Int. Cl.
*F15B 15/18* (2006.01)
*F15B 15/14* (2006.01)
(Continued)

(52) U.S. Cl.
CPC ..... *F15B 15/18* (2013.01); *F15B 11/10* (2013.01); *F15B 15/1428* (2013.01);
(Continued)

(58) Field of Classification Search
CPC .. F15B 15/18; F15B 15/1428; F15B 15/1485; F15B 15/28
(Continued)

(56) References Cited

U.S. PATENT DOCUMENTS 2,680,952 A 6/1954 Hurkamp et al.
4,630,441 A 12/1986 Chamberlain
(Continued)

FOREIGN PATENT DOCUMENTS

CN 103791143 A 5/2014
CN 102853149 B 12/2014
(Continued)

OTHER PUBLICATIONS

International Search Report issued for International Patent Application No. PCT/EP2017/061625 dated Aug. 4, 2017.

*Primary Examiner* — Michael Leslie
*Assistant Examiner* — Daniel S Collins
(74) *Attorney, Agent, or Firm* — Myers Wolin, LLC

(57) ABSTRACT

An electrohydraulic linear actuator comprises a housing consisting of a tubular profile, which forms a housing shell and in which there is a plurality of cavities, and which is closed at the ends by two housing covers fitted to the ends of the housing shell. A first cavity of the tubular profile forms a cylinder which forms the hydraulic cylinder of a double-acting synchronous cylinder and a second cavity which extends parallel to the first cavity accommodates a hydraulic unit in addition to the hydraulic cylinder, and a hydraulic oil reservoir is formed in said second cavity. Two working chambers of the hydraulic cylinder are separated from each other by a piston unit. The housing has at least one through-hole for a coupling element which forms a mechanical interface with the piston unit. The electric motor of the hydraulic unit is configured as a brushless outrunner motor.

15 Claims, 1 Drawing Sheet

(51) Int. Cl.
*F15B 11/10* (2006.01)
*F15B 15/28* (2006.01)

(52) U.S. Cl.
CPC ..... *F15B 15/1485* (2013.01); *F15B 15/28* (2013.01); *F15B 15/2861* (2013.01); *F15B 2211/20515* (2013.01); *F15B 2211/20561* (2013.01); *F15B 2211/3058* (2013.01); *F15B 2211/7054* (2013.01)

(58) Field of Classification Search
USPC ..... 60/476, 473
See application file for complete search history.

(56) References Cited

U.S. PATENT DOCUMENTS

| | | | | |
|---|---|---|---|---|
| 5,144,801 | A | 9/1992 | Scanderbeg et al. | |
| 5,519,995 | A | 5/1996 | Sasse et al. | |
| 6,543,223 | B2 | 4/2003 | Muschong et al. | |
| 2003/0126981 | A1* | 7/2003 | Bridger | F15B 1/024 91/459 |
| 2006/0207247 | A1 | 9/2006 | Nagai et al. | |
| 2017/0252585 | A1* | 9/2017 | Desgroseilliers | A62B 3/005 |
| 2018/0022441 | A1* | 1/2018 | Huynh | B64C 13/40 244/99.6 |

FOREIGN PATENT DOCUMENTS

| | | | |
|---|---|---|---|
| DE | 69012403 | T2 | 2/1995 |
| DE | 20201058 | U1 | 4/2002 |
| DE | 102004036943 | A1 | 3/2005 |
| WO | 9423231 | A1 | 10/1994 |
| WO | 2015187688 | A1 | 12/2015 |

* cited by examiner

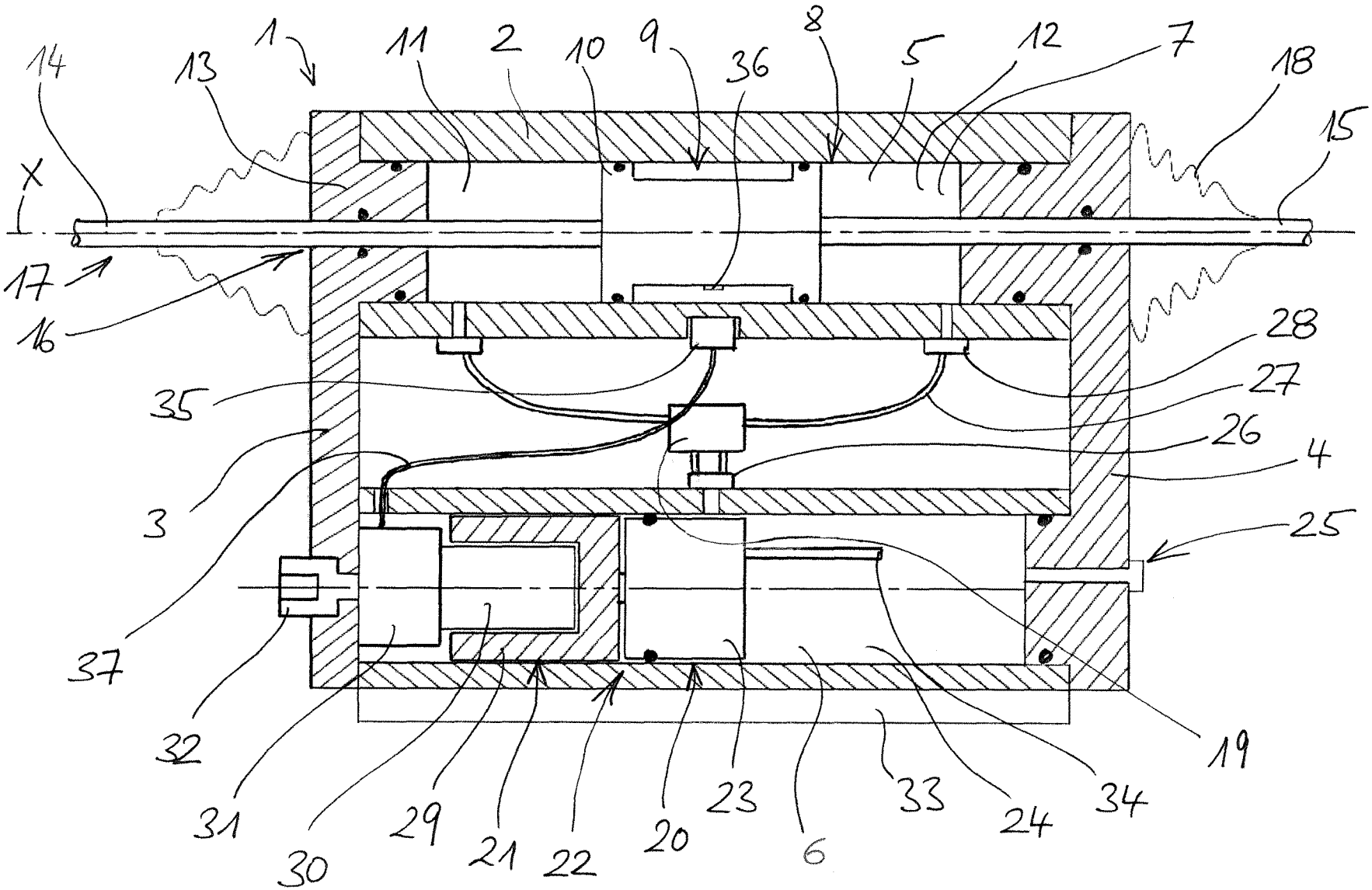
15
18
7
12
5
8
36
9
10
2
11
1
13
14
X
17
16
28
27
26
4
25
19
34
24
33
6
23
20
22
21
29
30
31
32
37
3
35

ELECTROHYDRAULIC LINEAR ACTUATOR

CROSS REFERENCE TO RELATED APPLICATIONS

This application is a continuation under 35 U.S.C. § 120 of International Application PCT/EP2017/061625, filed May 15, 2017, which claims priority to German Application No. 10 2016 109 103.0, filed May 18, 2016, the contents of each of which are incorporated by reference herein.

FIELD OF THE INVENTION

The present invention relates to an electrohydraulic linear actuator.

BACKGROUND

Actuators are used for actuation of mechanical loads or other driven elements. Depending on the geometry of movement of their take-off unit, a distinction can be made between rotary actuators—which execute or urge a rotary movement—on the one hand and linear actuators—which execute or urge a linear movement—on the other hand. A special group among the latter is constituted by electrohydraulic linear actuators with a purely electrical input interface and a mechanical output interface, wherein all components and functional elements disposed functionally between the input interface and the output interface are part of a uniform, closed, preassembled assembly.

Electrohydraulic linear actuators are known and in use in various designs. The prior art includes in particular electrohydraulic linear actuators such as disclosed in WO 2015/187688 A1, U.S. Pat. No. 6,543,223 B2, U.S. Pat. Nos. 4,630,441 A, 2,680,952 A, DE 102004036943 A1, U.S. Pat. Nos. 5,144,801 A and 5,519,995 A.

SUMMARY

In view of the existing prior art, the present invention is directed toward providing an electrohydraulic linear actuator, which is characterized by particularly good suitability in practice. Depending on specific boundary conditions of the respective use, various more or less stringent requirements may apply, such as, for example, compact overall dimensions, high efficiency, high dynamic response during positioning, light weight, high force at the mechanical output, high reliability and/or long useful life, little noise generation, good manipulability, low manufacturing costs, high ease of maintenance, etc.

According to the present invention, an electrohydraulic linear actuator that extensively satisfies many of the applicable requirements for typical applications in the spirit of a particularly practical compromise is characterized by the following features acting together in combination:

- the linear actuator comprises a housing, in which a hydraulic cylinder, a hydraulic unit pressurizing this and a hydraulic-oil reservoir are housed;
- relative to the axis of the hydraulic cylinder, the hydraulic unit and the hydraulic-oil reservoir are disposed next to the hydraulic cylinder;
- the housing consists of a profile tube, which forms a housing jacket and which is closed at the ends by means of two housing covers fitted on the axial faces of the housing jacket;
- the hydraulic cylinder is constructed as a double-acting synchronous cylinder with a piston unit, which is guided in a cylinder and which separates two working chambers of equal cross section from one another;
- the cylinder is formed by a first cavity of the profile tube;
- the housing is provided with at least one opening for a mechanical interface to the piston unit of the coupling element forming the hydraulic cylinder;
- the hydraulic unit is housed and the hydraulic-oil reservoir is constructed in a second cavity of the profile tube extending parallel to the first cavity;
- the electric motor of the hydraulic unit is constructed as a brushless external-rotor motor.

Despite highly compact overall dimensions, inventive electrohydraulic linear actuators, which do not require any kind of external hydraulics and are in functionally relevant communication with their surroundings solely via an electrical input interface and a mechanical output interface, supply a very high positioning force with high dynamic response during positioning. At the same time, effective removal of heat from the corresponding (loss) heat sources can be achieved by the hydraulic oil, for which a hydraulic-oil reservoir is provided that is disposed in the housing, namely in the second cavity of the housing jacket, wherein the corresponding heat can be dissipated effectively to the surroundings via the housing.

In this connection, the profile tube may consist in particular of aluminum, namely of the portion of an extruded aluminum section. Not only is this advantageous in the respect that it permits the manufacture of a dimensionally stable housing with relatively little effort, but also the good heat transfer that is decisive for the heat budget is ensured in this case.

During construction of the housing according to the present invention, the possibility exists of constructing the cylinder of the hydraulic cylinder directly in the housing in relatively simple manner, wherein the cylinder is preferably closed at the ends by stoppers molded onto the two housing covers. The electrical interface is then preferably provided in the region of one of the two housing covers, particularly preferably in the region of that cover which is adjacent to the electric motor of the hydraulic unit (which is housed in the second cavity of the profile tube). Alternatively, however, a supply cable may also penetrate through the cover in question.

However, it is not absolutely necessary for the cylinder of the hydraulic cylinder to be constructed directly in the housing as mentioned in the foregoing. To the contrary, it may be advantageous in turn under certain prerequisites if a separate component inserted in a cavity constructed in the housing also forms the cylinder of the hydraulic cylinder.

According to a preferred improvement of the invention, the hydraulic-oil reservoir is formed by the second cavity of the housing, which is constructed in the profile tube forming the housing jacket. In this case, the removal of heat from the system takes place directly via the hydraulic oil, which—in the region of the hydraulic-oil reservoir—is in contact with the housing of the linear actuator. In addition, such a construction of the inventive linear actuator also has considerable structural advantages, since the pump of the hydraulic unit can be placed directly in the cavity that (also) forms the hydraulic-oil reservoir. In this connection, it is particularly preferable for the hydraulic pump to be inserted, e.g. press-fitted or shrink-fitted, in heat-transferring relationship, in the corresponding cavity of the housing.

In a modified embodiment, however, it is also possible for the hydraulic-oil reservoir to form a separate component, which is inserted in the second cavity of the profile tube forming the housing jacket. Particularly preferably, the hydraulic-oil reservoir in this case is in heat-transferring contact over its surface with the inside wall of the cavity of the housing in which it is received. If necessary, a heat-conducting paste or the like may then provided between the hydraulic-oil reservoir and the housing for the purpose of optimum heat transfer. Incidentally, the fact, already mentioned in the foregoing, that the pump of the hydraulic unit is received (preferably in heat-transferring relationship) in the cavity of the housing, also proves to be advantageous in this configuration, i.e. in the case of a hydraulic-oil reservoir in the form of a separate component received in a cavity of the housing.

Another preferred improvement of the inventive electrohydraulic linear actuator is characterized in that the housing is provided on its outer face, spatially close to the hydraulic-oil reservoir, with surface profiling (in the form of ribs, for example) that increases the surface area. Even under extreme loading conditions of the electrohydraulic linear actuator, safe operating temperatures can be guaranteed in this way in particularly compact linear actuators.

According to yet another preferred improvement of the invention, it is particularly advantageous when the hydraulic-oil reservoir has a volume of at least twice the sum of the volumes of the two working chambers. This dimensioning is also favorable under viewpoints of a reliable heat budget.

For operation of the inventive electrohydraulic actuator, it proves to be advantageous when the hydraulic unit is reversible. Then it is possible in particular to dispense with any control valves between the hydraulic unit and the hydraulic cylinder. For control of the linear actuator, it is particularly preferred to connect a position sensor to the piston of the hydraulic cylinder.

Under certain prerequisites concerning the structural dimensions and the integration of the electrohydraulic linear actuator in the functional periphery, it may prove to be favorable when it is not a conventional piston rod extending out of the end of the housing (or two piston-rod portions extending out of the ends/axial faces of the housing) that is provided as the coupling element, but instead when the mechanical interface with the housing opening in question is realized in some other way, for example is disposed laterally on the housing, between the two hydraulic working chambers, in a manner comparable to the concept according to WO 94/23231 A1, CN 102853149 B and CN 103791143 A. By omitting the piston rod passing through the respective working chamber, a maximum piston face for given dimensions would be available in this case, with the result of a particularly large positioning force; in addition, there would be no need for seals of the piston rod (or of the two piston-rod portions) at its or their penetration(s) through the housing.

In yet another preferred improvement of the invention, a manually actuatable way valve is provided that is suitable for establishing direct hydraulic communication between the two working chambers of the hydraulic cylinder as an alternative to pressurization of the hydraulic cylinder by the hydraulic unit. By virtue of such a "short circuit" of the two working chambers, manual positioning of the piston unit from outside (via the coupling element) is possible in the case of a malfunction, for example during a power outage or failure of the control of the linear actuator caused by other reasons. Thus it is possible—in an emergency—manually to influence the position of the mechanical load, for the actuation of which the electrohydraulic linear actuator is provided, and in fact to do so as rapidly as possible and without complex provisions such as, for example, mechanical separation of the communication between coupling element of the linear actuator and mechanical load.

In this connection, the construction of the brushless electric motor belonging to the hydraulic unit as an external-rotor motor contributes particularly to the possibility of realizing an electrohydraulic linear actuator with especially high power density, i.e. an especially favorable relationship between mechanical power at the output and overall size. For applications in which the needed installation space of the electrohydraulic linear actuator is not the critical variable or the limiting factor, so that there is no decisive need for a small overall size, the other advantages of the inventive electrohydraulic linear actuator explained hereinabove (with the exception of the only minimal overall dimensions) can be achieved in a modification, namely by using a brushless internal-rotor motor instead of a brushless external-rotor motor.

BRIEF DESCRIPTION OF THE DRAWING

The present invention will be explained in more detail hereinafter on the basis of a preferred exemplary embodiment illustrated in partly schematic manner in the drawing. What is shown therein is a longitudinal section through an electrohydraulic linear actuator that realizes the present invention.

DETAILED DESCRIPTION OF THE PREFERRED EMBODIMENTS

This comprises a housing 1, which is joined together from three parts, namely from a housing jacket 2 and two housing covers 3, 4 fitted on the axial faces thereof. This housing jacket 2 is formed by a portion of a profile tube constructed as an extruded aluminum section. Several cavities 5, 6 are constructed therein and, corresponding to the manufacture of the housing jacket as an extruded section, extend continuously from one to the other housing cover 3, 4.

A first cavity 5 with a circular cylindrical cross section then forms cylinder 7—constructed directly in housing 1—of a hydraulic cylinder 8, which further comprises a piston unit 9, which can be guided displaceably in the cylinder along the axis and has two pistons 10 guided sealingly in cylinder 7. Hydraulic cylinder 8 is constructed as a double-acting synchronous cylinder, so that piston unit 9 separates two hydraulic working chambers 11, 12 of equal cross section from one another. For sealed closure at the ends of the two working chambers 11, 12, a stopper 13 projecting sealingly into first cavity 5 is provided on each of the two housing covers 3, 4.

Two piston-rod portions 14, 15, which extend through corresponding openings 16 provided in housing covers 3, 4, are connected to piston unit 9. These piston-rod portions 14, 15 respectively represent a coupling element 17, which—as the mechanical output of the linear actuator—forms a mechanical interface to piston unit 9 of hydraulic cylinder 8. To protect against dirt on piston-rod portions 14, 15 in the region of the respective penetration through the associated housing opening 16, two bellows 18 are provided (merely illustrated by way of example).

A reversible hydraulic unit 22, which pressurizes hydraulic cylinder 8 and comprises a hydraulic pump 20 and a brushless electric motor 21 driving this is housed in second cavity 6 of housing jacket 2, which extends parallel to first cavity 5. This pump housing 23 is inserted sealingly in cavity 6 in question, so that it further bounds a hydraulic-oil reservoir 24 constructed in second cavity 6 and formed by it.

Housing cover 4, likewise bounding hydraulic-oil reservoir 24, is provided with a filling and venting device 25 discharging into the hydraulic-oil reservoir. The two pressure outlets 26 of hydraulic pump 20 are in communication via lines 27 with respectively one port 28 of the hydraulic working chamber 11, 12 in question. Furthermore, an optionally provided way valve 19 is illustrated, which is provided fluidically between the two pressure outlets 26 of hydraulic pump 20 and ports 28 of the hydraulic working chambers 11, 12, and which is suitable, as an alternative to pressurization of hydraulic cylinder 8 by hydraulic unit 22, for establishing—via the corresponding portions of lines 27—direct hydraulic communication between the two working chambers 11 and 12. Way valve 19 can be manually actuated. For this purpose, an actuating lever disposed outside housing 1 and acting on way valve 19 is provided.

Electric motor 21 of hydraulic unit 22 comprises an external rotor 29 coupled with the pump rotor and an internal stator 30. The latter is mounted on a control block 31, which comprises the electronic controller and which in turn is attached to the associated housing cover 3. The electrical input interface 32 is situated on housing cover 3 in question. By the fact that hydraulic cylinder 8 on the one hand and the functional group comprising hydraulic-oil reservoir 24 and hydraulic unit 22 on the other hand are housed in two mutually parallel cavities 5, 6 of housing 1, an arrangement of hydraulic unit 22 and hydraulic-oil reservoir 24 laterally next to hydraulic cylinder 8 is obtained relative to axis X of hydraulic cylinder 8.

Housing jacket 2 is provided in its region surrounding hydraulic-oil reservoir 24 with cooling ribs 33 on its outside. Via these, not only is the temperature of the hydraulic oil contained in hydraulic-oil reservoir 24 controlled but also the loss heat produced in hydraulic pump 20 is removed. As regards a favorable heat budget, circulation of the hydraulic oil present in hydraulic-oil reservoir 24 is achieved—while avoiding a hydraulic short circuit—during pumping operation of hydraulic pump 20 by means of a tube 34, which projects into hydraulic-oil reservoir 24 and is connected to hydraulic pump 20.

Finally, a device for sensing the position of the piston unit is shown. This comprises a position sensor 35 integral with the housing and a transmitter 36 fixed on piston unit 9. The position signal of position sensor 35 is switched via signal line 37 to the electronic controller.

What is claimed is:

1. An electrohydraulic linear actuator wherein:

the linear actuator comprises a housing (1), in which a hydraulic cylinder (8), a hydraulic unit (22) pressurizing this and a hydraulic-oil reservoir (24) are housed;

relative to the axis (X) of the hydraulic cylinder (8), the hydraulic unit (22) and the hydraulic-oil reservoir (24) are disposed next to the hydraulic cylinder (8);

the housing (1) consists of a profile tube, which forms a housing jacket (2), in which several cavities (5, 6) are constructed and which is closed at the ends by means of two housing covers (3, 4) fitted on the axial faces of the housing jacket (2);

the hydraulic cylinder (8) is constructed as a double-acting synchronous cylinder with a piston unit (9), which is guided in a cylinder (7) and which separates two working chambers (11, 12) of equal cross section from one another;

the cylinder (7) is formed by a first cavity (5) of the profile tube;

the housing (1) is provided with at least one opening (16) for a mechanical interface to the piston unit (9) of the coupling element (17) forming the hydraulic cylinder (8);

the hydraulic unit (22) is housed and the hydraulic-oil reservoir (24) is constructed in a second cavity (6) of the profile tube extending parallel to the first cavity (5); and the electric motor (21) of the hydraulic unit (22) is constructed as a brushless external-rotor motor.

2. The electrohydraulic linear actuator of claim 1, wherein the housing covers (3, 4) are provided with stoppers (13) projecting into the first cavity (5).

3. The electrohydraulic linear actuator of claim 1, wherein a control block (31) comprising an electronic controller is attached to one housing cover (3).

4. The electrohydraulic linear actuator of claim 3, wherein the internal stator (30) of the electric motor (21) is mounted on the control block (31).

5. The electrohydraulic linear actuator of claim 3, wherein an electrical input interface (32) is situated on the housing cover (3) to which the control block (31) is attached.

6. The electrohydraulic linear actuator of claim 1, wherein the housing (1) is provided on its outer face, spatially close to the hydraulic-oil reservoir (24), with surface profiling that increases the surface area.

7. The electrohydraulic linear actuator of claim 1, wherein the hydraulic-oil reservoir (24) has a volume of at least twice the sum of the volumes of the two working chambers (11, 12).

8. The electrohydraulic linear actuator of claim 1, wherein the profile tube consists of aluminum.

9. The electrohydraulic linear actuator of claim 1, wherein the profile tube consists of the portion of an extruded section.

10. The electrohydraulic linear actuator of claim 1, wherein the cylinder (7) of the hydraulic cylinder (8) is constructed directly in the housing (1).

11. The electrohydraulic linear actuator of claim 1, wherein the hydraulic unit (22) is reversible.

12. The electrohydraulic linear actuator of claim 1, wherein no proportional control valves are present between the hydraulic unit (22) and the hydraulic cylinder (8).

13. The electrohydraulic linear actuator of claim 1, wherein the piston unit (9) of the hydraulic cylinder (8) is operatively connected to a position sensor (35).

14. The electrohydraulic linear actuator of claim 1, wherein the at least one opening (16) of the housing (1) for the coupling element (17) is disposed on the axial face of the housing (1).

15. The electrohydraulic linear actuator of claim 1, wherein a manually actuatable way valve (19) is provided, by means of which direct hydraulic communication can be established between the two working chambers (11, 12).

* * * * *